US007464938B1

(12) United States Patent
Anderson, Jr.

(10) Patent No.: US 7,464,938 B1
(45) **Date of Patent: *Dec. 16, 2008**

(54) LAYERED FOAM TARGET AND METHOD OF MANUFACTURING THE SAME

(75) Inventor: James D. Anderson, Jr., Rockwell, NC (US)

(73) Assignee: Delta Sports Products, LLC, Reinback, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/774,917

(22) Filed: Jul. 9, 2007

Related U.S. Application Data

(63) Continuation of application No. 11/195,228, filed on Aug. 2, 2005, now Pat. No. 7,258,345.

(51) Int. Cl.
*F41J 3/00* (2006.01)

(52) U.S. Cl. ..... 273/408

(58) Field of Classification Search ..... 273/403, 273/404, 407, 408

See application file for complete search history.

(56) References Cited

U.S. PATENT DOCUMENTS 4,813,684 A * 3/1989 Bruno ..... 273/403
4,940,244 A * 7/1990 Batts, III ..... 273/403
5,465,977 A * 11/1995 Mann ..... 273/408
5,865,440 A * 2/1999 Pulkrabek ..... 273/408
6,254,100 B1 * 7/2001 Rinehart ..... 273/403
6,799,764 B2 * 10/2004 Ingold ..... 273/403
6,926,281 B1 * 8/2005 Woock ..... 273/403
7,258,345 B2 * 8/2007 Anderson, Jr. ..... 273/408
2004/0007819 A1 * 1/2004 Twichell ..... 273/404
2004/0140623 A1 * 7/2004 Pulkrabek ..... 273/408
2006/0157938 A1 * 7/2006 Box et al. ..... 273/403

* cited by examiner

*Primary Examiner*—Mark S Graham
(74) *Attorney, Agent, or Firm*—Ryan N. Carter

(57) ABSTRACT

An archery target is manufactured by stacking a plurality of layers of foam with the bottom surface of an upper layer engaging the top surface of a lower layer in face-to-face engagement to form a stack having a top surface, a bottom surface and a plurality of side surfaces. The foam layers are compressed and the layers of foam are secured to each other by applying heat to the side surfaces such that a plurality of target faces of at least partially melted foam are formed. The layers of foam are further integrated to one another by applying a heated rod through the entire stack to form at least one hole extending through the layers. The archery target is capable of being used in a stand-alone arrangement having at least four target faces and could be used as an insert for a three-dimensionally shaped target shell.

1 Claim, 4 Drawing Sheets

LAYERED FOAM TARGET AND METHOD OF MANUFACTURING THE SAME

CROSS-REFERENCE TO RELATED APPLICATION

This application is a continuation of U.S. patent application Ser. No. 11/195,228 filed on Aug. 2, 2005.

BACKGROUND OF THE INVENTION

This invention relates to archery targets and, more particularly, to an archery target constructed of multiple foam layers stacked in face-to-face engagement with one another and heat integrated to provide a self-supporting archery target capable of use in a stand-alone arrangement, as a removable insert and/or a removable insert that can also be used as a stand-alone arrangement.

Various styles of archery targets are available to safely capture arrows. A common essential feature for layered archery targets is that the layers must be sufficiently compressed against each other in order to safely capture an arrow and prevent the arrow from escaping through the layers. Compression of the layers is achieved by different means. In U.S. Pat. Nos. 5,465,977 and 5,865,440, band retainers are secured around the target to maintain compression and retain the layers in contact to one another. One disadvantage of this configuration is that only two out of four side surfaces may be used as target faces since the side surfaces having the bands could not be used without the risk of striking and damaging a band.

U.S. Pat. No. 6,799,764 B2 discloses a layered foam archery target that uses cables at each corner of the target to maintain a compressive force between the layers. Each cable end is connected to a top and bottom support member. Although this design enables a user to utilize all four sides of the target as target faces, there is still a risk of striking and disconnecting the cables located at the corners of the target. Furthermore, support members are essential to secure the cables and maintain a compressive force.

Other forms of archery targets are available where the target is inserted into a structure such as three-dimensional animal-like figures. U.S. Patent Application Publication No. 2004/0140623 A1 shows an archery target secured within an animal shell. The archery target is locked inside the animal shell by a pivoting top cover. Thus, an additional rigid component is needed to secure the archery target which will cause arrow damage.

Thus, a need exists for a self-supporting archery target capable of maintaining a compressive force between the layers without additional components and also capable of being used as an easily removable insert.

BRIEF SUMMARY OF THE INVENTION

In one aspect, the present invention is an archery target comprising a plurality of layers of foam, each layer having a top surface, a bottom surface and a plurality of side surfaces. The layers are stacked with the bottom surface of an upper layer engaging the top surface of a lower layer in face-to-face engagement with one another and the layers include at least one hole extending partially through the layers where the layers are secured to each other in an internal surface area defined by the at least one hole. The layers of foam are further integrated with each other by securing the plurality of side surfaces to each other.

In another aspect, the present invention is an archery target comprising a target shell three-dimensionally shaped into the form of an animal. The shell has a cavity with a plurality of side surfaces that define the cavity and the cavity receives a foam target having a top, a bottom, and a plurality of side surfaces forming a plurality of flat target faces. The target is releasably positioned within the cavity with one flat target face exposed and a balance of remaining flat target surfaces being located within the cavity.

Another aspect, the present invention is an archery target comprising a target shell 3-dimensionally shaped in the form of an animal. The shell has a cavity with a plurality of side surfaces that define the cavity. The target also includes a stand-alone foam target having a top, a bottom, and a plurality of side surfaces having a plurality of flat target surfaces. The stand-alone foam target is sufficiently sized to function as a stand-alone target and is complementally sized to be releasably positioned within the cavity with one target surface exposed whereby the stand-alone target can be used alone or in combination with the target shell.

In another aspect, the present invention is an archery target comprising a target shell 3-dimensionally shaped into the form of an animal. The shell has a cavity with a plurality of side surfaces that define the cavity. The target also includes a foam target formed of a plurality of layers of foam, each layer having a top surface, a bottom surface and a plurality of side surfaces. The layers are stacked with the bottom surface of an upper layer engaging the top surface of a lower layer in face-to-face engagement with one another. The layers are secured to each other and are releasably positioned within the cavity with at least one target surface exposed. The target is oriented in the cavity in one of a first position wherein the layers of foam are generally horizontal and a second position wherein the layers of foam are generally vertical.

In yet another aspect, the present invention is a method of manufacturing an archery target comprising the steps of stacking a plurality of layers of foam with the bottom surface of an upper layer engaging the top surface of a lower layer in face-to-face engagement to form a stack of layers having a top surface, a bottom surface and a plurality of side surfaces; compressing the foam layers by applying a pressure to at least one of the top and bottom surfaces; and securing the layers of foam to each other by applying heat to the side surfaces such that a plurality of target faces of at least partially melted foam are formed.

BRIEF DESCRIPTION OF THE SEVERAL VIEWS OF THE DRAWINGS

The foregoing summary, as well as the following detailed description of presently preferred embodiments of the invention, will be better understood when read in conjunction with the appended drawings, some of which are diagrammatic. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
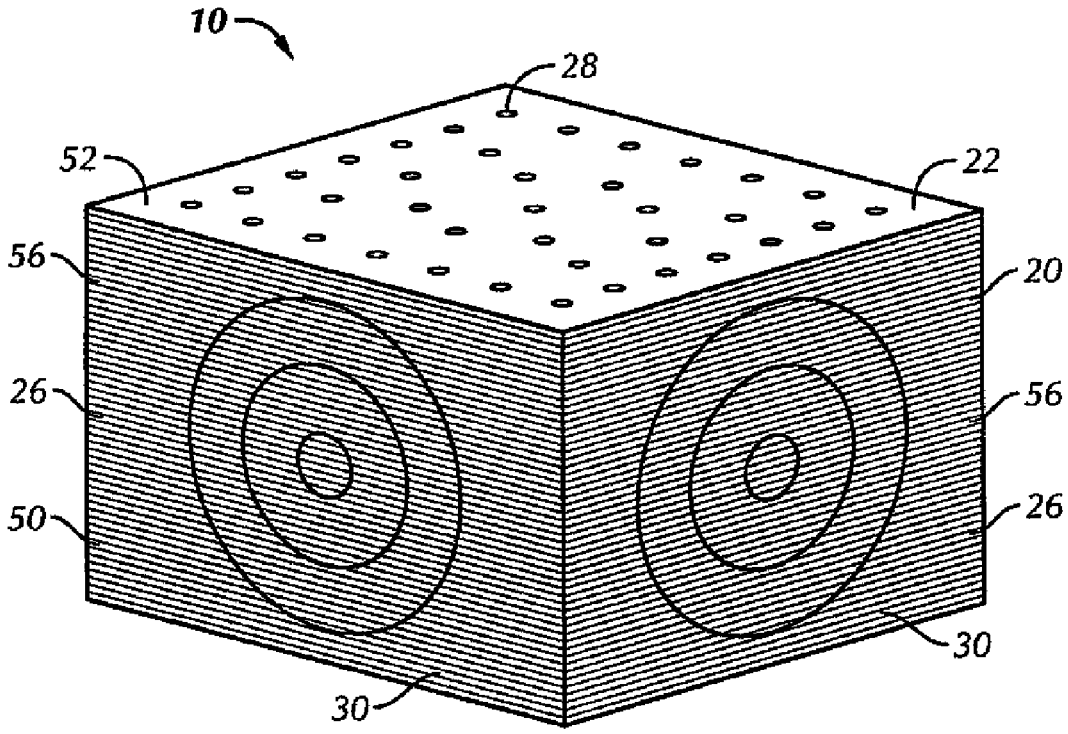
FIG. 1 is a perspective view of an archery target in accordance with a first preferred embodiment of the present invention.

Certain terminology is used in the following description for convenience only and is not limiting. The words "right", "left", "upper" and "lower" designate directions in the drawings to which reference is made. The words "inwardly" and "outwardly" refer to directions toward and away from, respectively, the geometric center of the archery target and designated parts thereof. The word "a" is defined to mean "at least one." The terminology includes the words above specifically mentioned, derivatives thereof, and words of similar import.

Referring to the drawings in detail, wherein like numerals indicate like elements throughout, there is shown a layered archery target, in accordance with the present invention. FIG. 1 illustrates that a first preferred embodiment of an archery target 10 includes a plurality of layers of foam 20, each foam layer having a top surface 22, a bottom surface 24 (FIG. 2B) and a plurality of side surfaces 26. The foam layers 20 are preferably constructed of polyethylene foam. One of ordinary skill in the art would recognize that other materials could be substituted such as other polymers, without departing from the spirit and scope of the invention. Each individual layer 20 is of a thickness between approximately one-sixteenth and one-quarter of an inch, and preferably of about one-eighth of an inch with a density range between 4 and 8 pounds per cubic inch. Again, one of ordinary skill in the art would recognize that layers of other thicknesses and densities could be used so long as the effectiveness of the archery target is not compromised.

The foam layers 20 are stacked in face-to-face compressive engagement with one another to form a stack 50 having a top surface 52, a bottom surface 54 (FIG. 2B) and side surfaces 56. Each of the side surfaces of each of the foam layers 26 are heat-integrated or otherwise secured together with one another to form the side surface 56 of the stack 50. The term secured together, as used in the previous sentence, means adhered together through a melting process as opposed to merely being in touching contact. Each heat-integrated side surface 56 is used as a flat target face 30. However, it is understood by those of ordinary skill in the art that the side surface 56 need not be flat, but could have a desired contoured shape. The foam layers 20 are further integrated with one another with heat-produced holes 28 or other securing means that extend from the top surface 52 through the bottom surface 54.

The archery target 10 may be used as a stand-alone structure having no additional supports. Each heat-integrated side surface 56 may be utilized as a target. A user may alternate between one side surface 56 and another side surface 56 depending on preference, amount of wear, etc.

Figure 2A:
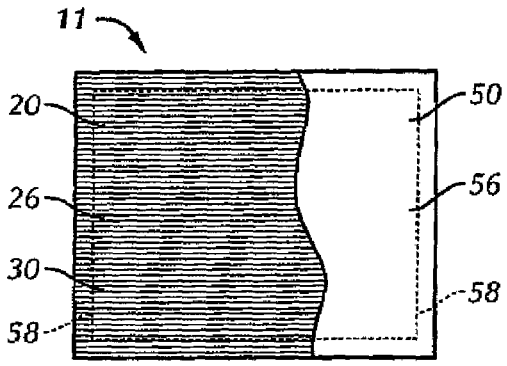
FIG. 2A is a partial side cross-sectional elevational view of a target face of an archery target in accordance with a second embodiment of the present invention.
Figure 2B:
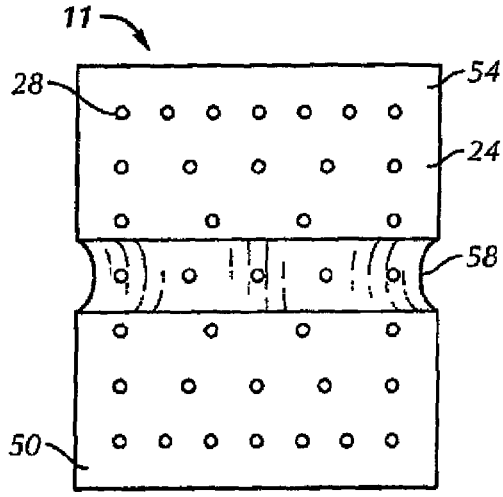
FIG. 2B is a bottom elevation view, which is identical to a top elevation view, of the archery target of FIG. 2A.
Figure 2C:
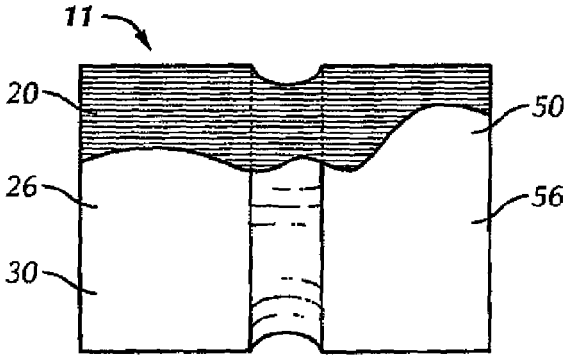
FIG. 2C is a partially broken away side elevation view of a non-target face of the archery target of FIG. 2A.

Referring to FIGS. 2A-2C, an archery target 11 of a second embodiment is shown. The general makeup of the archery target 11 is identical to the archery target 10 of the first embodiment. Thus, identical components will not be repeated for convenience. The archery target 11 includes four indents 58 located on opposite side surfaces 56, preferably having generally semi-circular cross-sections. The indents 58 are used as locking means and will be described in further detail below. One of ordinary skill in the art would recognize that other shapes and sizes could be substituted for the indents 58 so long as the indents can be properly fitted as a locking device. Although the archery target 11 contains indents 58, it may still be used as a stand-alone target. While the archery target 11 shown in FIGS. 2A-2C includes four indents 58, it is understood by those of ordinary skill in the art that a lesser number of indents, such as two, can be used to secure the target, as described in more detail below.

Figure 3:
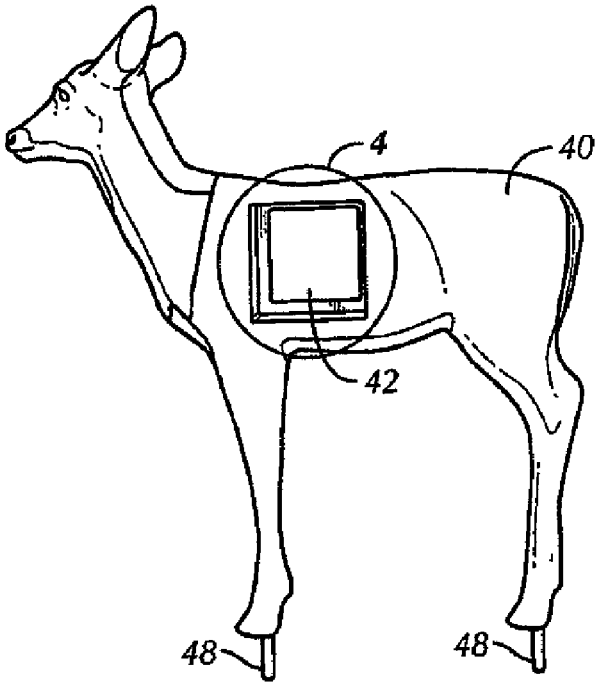
FIG. 3 is a side elevation view of a three-dimensionally shaped target shell in accordance with a second embodiment of the present invention.
Figure 5:
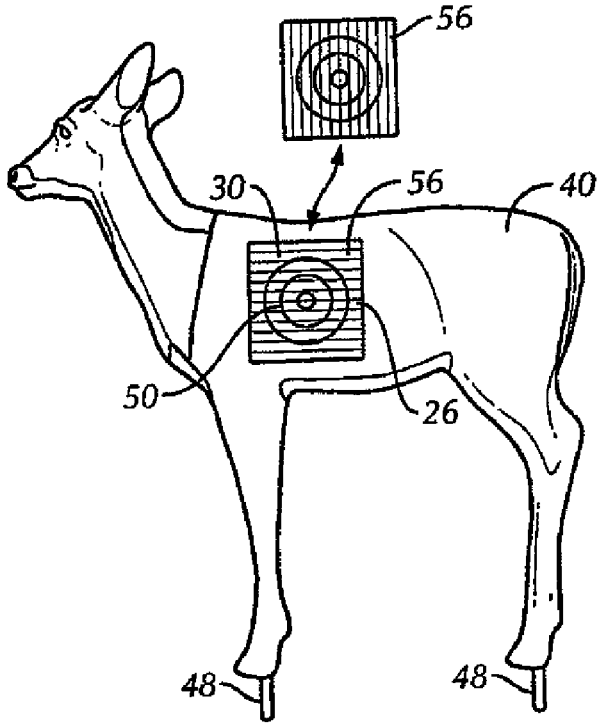
FIG. 5 is a side elevation view of the three-dimensionally shaped target shell of FIG. 3 with the archery target of FIGS. 2A-C inserted within the cavity of FIG. 4.
Figure 4:
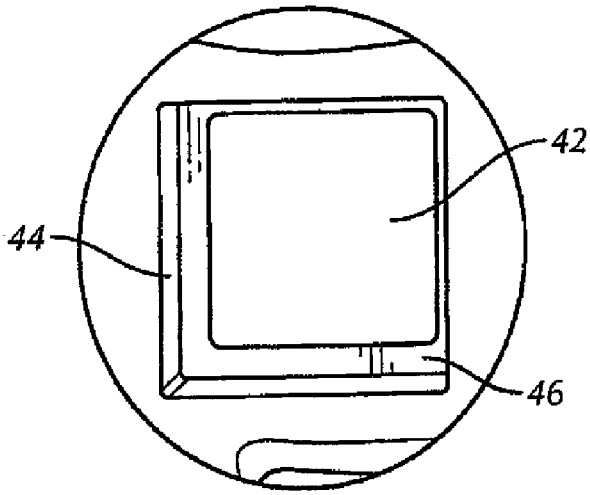
FIG. 4 is a side perspective view of a cavity of the three-dimensionally shaped target shell of FIG. 3.

Referring to FIGS. 3-5, also included in the second embodiment is a three-dimensional (3-D) target shell 40 having a cavity 42 to accommodate the archery target 11. In the preferred embodiment, the 3-D target shell 40 is shaped like a deer but one of ordinary skill in the art would recognize that other forms of animal shapes (e.g., elk) or non-animal shapes could be substituted. The cavity 42 includes side surfaces 44 extending along the cavity 42 perimeter and protrusions 46 extending along a middle portion of the side surfaces 44. The side surfaces 44 extend from one lateral end to another lateral end of the 3-D target shell 40. Furthermore, the protrusions 46 are sized such that the indents 58 of the archery target 11 are capable of snugly fitting around the protrusions 46. The archery target 11 is inserted and secured in the cavity 42, and made integral with the 3-D target shell 40 by locking the indents 58 around the protrusions 46. When the archery target 11 is positioned within the cavity 42, it provides 2 different target surfaces on opposite sides of the target shell 40. One of ordinary skill in the art would recognize that the location, shape and size of the cavity 42, the indents 58 and the protrusions 46 could be varied so long as a secure locking means can be formed. For instance, instead of placing an indent on all four sides of the archery target 11, two criss-crossed indents can be placed in the top and bottom surfaces of the archery target and only two protrusions at the upper and lower surfaces of the cavity 42 could be provided (not shown). Similarly, the archery target 11 could be generally in the shape of a square cube. This would allow all four side surfaces to be used as target surfaces by repositioning and rotating the target within the cavity 42. Similarly, the target 11 could be rotated 90 degrees such that the layers of foam 20 extend generally vertically to allow for target practice from a tree stand or other elevated position.

The 3-D target shell 40 is supplied with at least one bar such as a rebar (not shown), which is driven into the ground. The legs of the shell 40 include an encapsulated conduit (not shown) for receiving the bar to support the shell 40 in an upright position. Alternatively, as shown in FIGS. 3 and 5, the shell 40 includes stakes 48 located at a bottom portion of the target shell 40. The stakes 48 are driven into a ground surface such that the target shell 40 will remain upright despite a sudden applied force of an arrow to the archery target 11.

Figure 6:
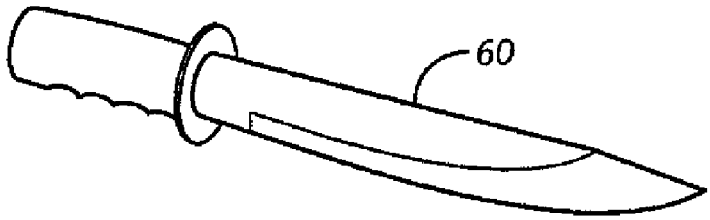
FIG. 6 is a perspective view of a heated knife.
Figure 7:
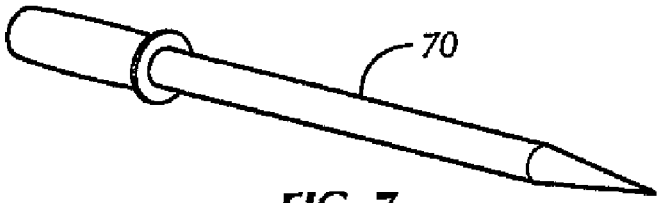
FIG. 7 is a perspective view of a heated rod.

The archery targets of the first and second embodiments 10, 1, respectively, are manufactured using a heated knife 60 shown in FIG. 6 and a heated rod 70 shown in FIG. 7. A plurality of layers of foam 20 are stacked in face-to-face engagement to form a stack 50 having a top surface 52, a bottom surface 54 and a plurality of side surfaces 56. Although it is preferred that the foam layers 20 are similarly shaped and sized so that the layers 20 could be stacked in alignment, it is not essential that the layers are similar nor is it essential that the layers are aligned with one another. The foam layers 20 are compressed by applying a pressure to at least one of the top and bottom surfaces 52, 54. The compression force should be sufficient to achieve a half inch of compression for every 8 inches of target length, although different compressive forces could be used depending on the density of the foam without departing from the spirit and scope of the invention. Pressure can be applied by hand or machine so long as the side surfaces 56 are not blocked.

The layers of foam 20 are secured to each other by applying heat to the side surfaces 56 with the heated knife 60 such that a plurality of flat target faces 30 of at least partially melted foam are formed. Once the melted side surfaces 56 are sufficiently cooled, pressure is removed from the stack 50 and the foam layers 20 are further integrated by applying a heated rod 70 through the top surface 52 and extending the rod 70 through the bottom surface 54. Thus, the layers are heat-sealed to each other in an internal surface area defined by the holes 28 formed by the heated rod 70. The additional seal formed by the holes 28 further maintains the compressive force between the layers 20. The knife 60 and the rod 70 may be heated by various means including but not limited to direct heat and electricity. Furthermore, the knife 60 and the rod 70 need not be sharp. One of ordinary skill in the art would recognize that the steps for manufacturing the archery target 10 could vary, for example, applying the heated rod 70 before removing pressure from the stack 50; securing the layers of foam 20 together in an uncompressed state; or using a hot plate or hot wire (now shown) instead of a hot knife 60.

In operation, the archery target 10, 11 is placed at a desired distance from a shooter, in a location such that stray arrows (not shown) will not cause damage or injury. The archery target 10, 11 may be used with any type of arrow point combined with any type of arrow shaft. As the arrow point (not shown) strikes the target face 30, the arrow point pierces the side surface 56 and enters between the layers of foam 20. Friction between the arrow point and the compressed layers 20 quickly dissipates the kinetic energy of the arrow, safely capturing the arrow in the archery target 10, 11 yet causing minimal damage to the layers 20. The arrow may be then easily removed from the archery target 10, 11 and the layers 20 close back around where the arrow point had been captured. As mentioned above, the archery target 10 can be used as a stand-alone target or the archery target could be modified to be releasably positioned within a 3-dimensional target shell 40 having a cavity 42. It is also understood that the target 11 positioned within the cavity 42, could be removed from the cavity 42 and used as a stand-alone target.

The archery target 10, 11 can be used either indoors or outdoors and is highly resistant to damage. In addition, the archery target 10, 11 is lightweight, portable, and weather-resistant. Furthermore, the archery target 10, 11 is durable, and particularly cost-effective, as the target provides four surfaces suitable for capturing arrows.

While preferred foam density and compressive forces are set forth above, the absolute numbers will vary depending on the application, type of foam density, target size, and the desired friction force applied to the arrow shaft.

It will be appreciated by those skilled in the art that changes could be made to the embodiments described above without departing from the broad inventive concept thereof. For instance, the hot knife 60 could be used to merely cut away excess foam. It is understood, therefore, that this invention is not limited to the particular embodiments disclosed, but it is intended to cover modifications within the spirit and scope of the present invention.

What is claimed is as follows:

1. A method of manufacturing an archery target, the method comprising the steps of:

(a) stacking a plurality of layers of foam with the bottom surface of an upper layer engaging the top surface of a lower layer in face to face engagement to form a stack of layers having a top surface, a bottom surface and a plurality of side surfaces;

(b) compressing the foam layers by applying a pressure to at least one of the top and bottom surfaces; and (c) pushing a heated rod through one of the top and bottom surfaces toward the other of the top and bottom surfaces through at least some of the plurality of layers of foam.

* * * * *